US005862531A

United States Patent [19]

Ross

[11] Patent Number: 5,862,531

[45] Date of Patent: Jan. 26, 1999

[54] BASEBALL BATTING AND FIELDING PADDED UPPER TORSO GARMENT

[76] Inventor: Jeremy Ross, 382 E. Shore Rd., Great Neck, N.Y. 11023

[21] Appl. No.: 905,568

[22] Filed: Aug. 4, 1997

[51] Int. Cl.[6] ..... A41D 13/00

[52] U.S. Cl. ..... 2/463; 2/465

[58] Field of Search ..... 2/463, 462, 464, 2/465, 467, 455

[56] References Cited

U.S. PATENT DOCUMENTS

| | | | |
|---|---|---|---|
| 1,777,878 | 10/1930 | Evans | 2/465 |
| 2,990,549 | 7/1961 | Doughty | 2/464 |
| 3,500,472 | 3/1970 | Castellani | 2/464 |
| 3,991,420 | 11/1976 | Savarino | 2/464 |
| 4,084,264 | 4/1978 | Marion | 2/464 |
| 4,373,211 | 2/1983 | Goudreau et al. | 2/464 |
| 4,441,211 | 4/1984 | Donzis | 2/464 |
| 4,866,789 | 9/1989 | Dorm | 2/465 |
| 4,870,706 | 10/1989 | Ketcham et al. | 2/465 |
| 4,985,934 | 1/1991 | Perry | 2/465 |
| 5,325,537 | 7/1994 | Marion | 2/464 |
| 5,640,719 | 6/1997 | Ritchie | 2/465 |

*Primary Examiner*—Michael A. Neas
*Attorney, Agent, or Firm*—Myron Amer PC

[57] ABSTRACT

A garment with sleeves, worn on a baseball player's upper torso, which has rib cage-protective padding beneath a so-called pad-positioning sleeve so that, in use, a baseball player batting right-handed inserts a left hand through the pad-positioning sleeve and, after turning the garment around, a baseball player batting left-handed inserts a right hand through the pad-positioning sleeve and, by following this simple fitting procedure in both instances the single garment positions the protective pad in covering relation over the player's rib cage.

1 Claim, 1 Drawing Sheet

BASEBALL BATTING AND FIELDING PADDED UPPER TORSO GARMENT

The present invention relates generally to protective garments for those participating in athletics, and more particularly to a single protective garment that can be used for baseball players batting either left or right-handed.

It is already well known, according to common experience, that there is utility in an athlete, or one participating in athletics, to wear an injury-obviating pad or covering over a vulnerable body area, as exemplified by a football player wearing shoulder pads, a baseball umpire wearing a so-called chest protector, and baseball players wearing a helmet.

The within inventive garment is worn over the user's upper torso and is intended specifically for baseball players to protect against a rib cage injury as might result from an errant pitched baseball and the circumstance that the rib cage is in facing relation to the trajectory of the thrown pitch.

There are no known rib cage-protecting batting upper torso garments in use, and this non-use is presumed because of the need to accommodate to the left or right-handed style of the user, and requiring proper positioning of the protective pad in covering relation over the vulnerable rib cage area.

Broadly, it is an object of the present invention to provide a single inventive garment for both righties and lefties.

More particularly, it is an object to provide a garment with properly positioned protective pads during its construction, and correspondingly providing properly positioned pads in relation to the rib cage area during batting use merely upon following simple wearing instructions, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 5:
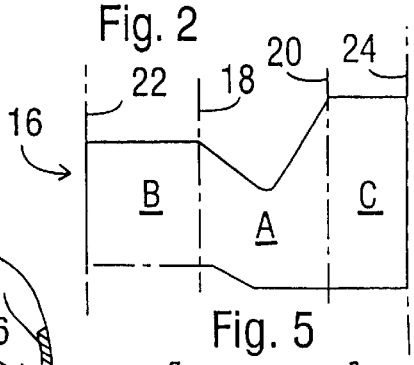
FIG. 5 is an isolated view of the pad of the within inventive garment shown in the flat.
Figure 6:
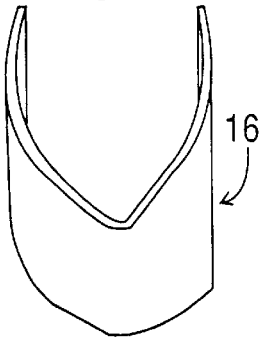
FIG. 6 is also an isolated view of the pad, but shown in perspective.

The within upper torso garment, generally designated 10, has sewn in an appropriate matter onto the interior surface 12 of its outer fabric 14, a pad 16 as shown in isolated perspective in FIGS. 5 and 6, in which there is a middle extent delineated by the lines 18 and 20 and designated A, an adjacent extent delineated by the lines 18 and 22 and designated B, and an opposite adjacent extent delineated by the lines 20 and 24 and designated C.

The fabric garment 10 is constructed with shoulder-covering panels 26, edges 28 bounding a neck opening 30 in the shoulder-covering panels and a body 32 connected in depending relation from the shoulder-covering panels providing garment panels for the attachment of the panels B and C. The garment 10 is completed by sleeves attached to extend laterally of the garment at the junctures 34 of the shoulder panels 26 and body 32.

The pad 16 will be understood to be of elastomeric construction material 36 that is readily commercially available and, by common experience, known to absorb the shock of impact and thus minimize injury to a body area beneath the pad. To use to advantage the pad 16, there is provided as one of the sleeves, a sleeve aptly designated as the garment pad-positioning sleeve, designated 40, and the other sleeve 42 is merely for fitting the garment on the baseball player 44.

Figure 1:
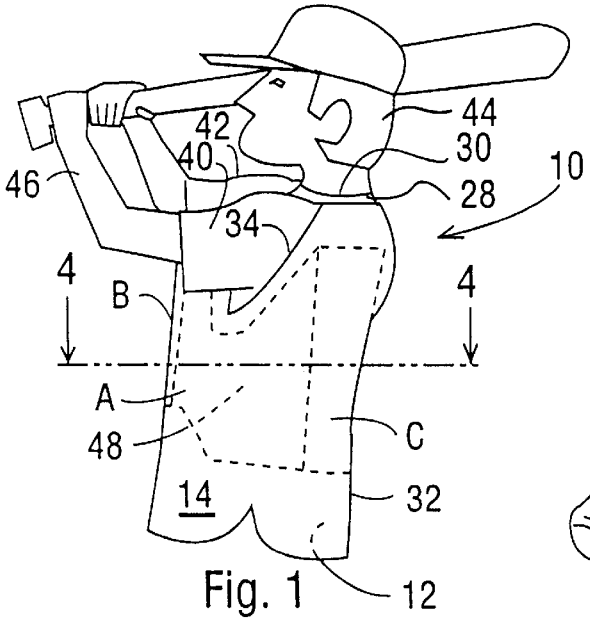
FIG. 1 is a perspective view of a baseball player batting right-handed using the padded upper torso garment according to the present invention.
Figure 2:
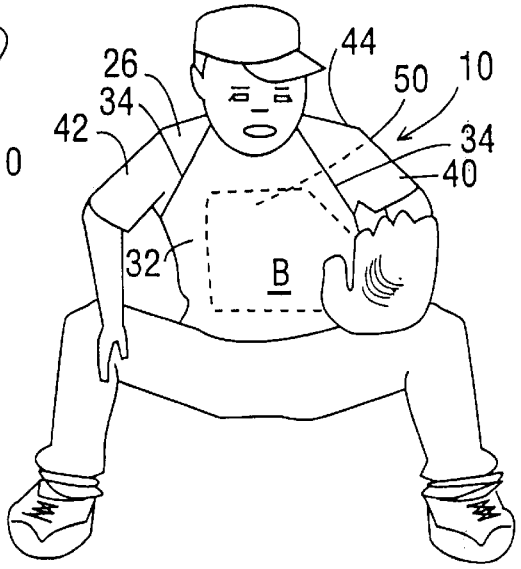
FIG. 2 is a front perspective view of a baseball player in a fielding stance using the padded upper torso garment according to the present invention.
Figure 3:
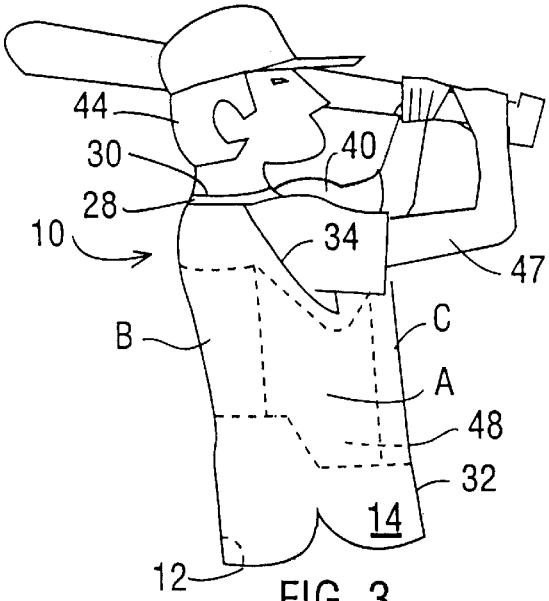
FIG. 3 is a view similar to FIG. 1, but for a baseball player batting left-handed.
Figure 4:
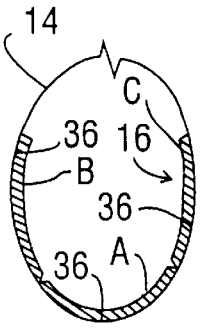
FIG. 4 is a cross sectional view as taken along line 4—4 of FIG. 1.

In use, and constituting the crux of the invention, the baseball player 44, whether batting right-handed as illustrated in FIG. 1 or left-handed as illustrated in FIG. 3 will, in the circumstance of FIG. 1 insert his/her left arm 46 in the pad-positioning sleeve 40 and in the circumstance of FIG. 3 insert his/her right arm 47 in the pad-positioning sleeve 40 and in both instances achieve similar protection against injury to his/her rib cage 48.

The same garment 10, worn with the appropriate arm inserted in the pad-positioning sleeve 40, thus is effective to minimize rib cage injury irrespective of right-handed or left-handed batting styles.

The adjacent pads B and C contribute to minimizing body injuries to a fielding baseball player as might occur due to a struck baseball taking a bad "hop" on the baseball field, because of their capability of assuming a position in covering relation over the players chest 50 for either a right-handed or left-handed batting and throwing baseball player 44.

It should be noted that, to contribute to the comfort in wearing the garment 10, the neck opening 30 is selected to be of an appropriate shape and size so that the edges 28 are in clearance positions from the user's neck whether worn as illustrated in FIG. 1 or worn as illustrated in FIG. 3.

In a preferred embodiment of a large-sized garment 10, pads B and C are rectangles measuring 9×10 inches and 14×7 inches, respectively, and the rib cage covering pad A measures 12 inches in width.

While the upper torso garment herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of wearing an upper torso padded garment by a baseball player of a type having an upper shoulder-covering shoulder panel, edges in said shoulder panel bounding a neck opening, a tubular upper torso-encircling body panel extending in depending relation from said shoulder panel, and a rib cage-protecting pad in a semi-circular configuration secured to a side of said body panel, said wearing method providing an option to said baseball player of batting right-handed and left-handed comprising the steps of attaching a first sleeve to extend in a first direction laterally of said garment for pad-positioning of said rib cage-protecting pad and a second sleeve to extend in a second opposite direction laterally of said garment for a fitting of said garment upon said upper torso of said baseball player, inserting a left arm of a baseball player through said first sleeve preparatory to batting right-handed, and inserting a right arm of a baseball player through said first sleeve preparatory to batting left-handed, whereby in batting right-handed and in batting left-handed there occurs automatic positioning of said rib cage-protecting pad in facing relation to a pitched baseball.

* * * * *